US011791117B2

(12) United States Patent
Miyake et al.

(10) Patent No.: US 11,791,117 B2
(45) Date of Patent: Oct. 17, 2023

(54) ELECTROMAGNETIC RELAY

(71) Applicant: OMRON Corporation, Kyoto (JP)

(72) Inventors: Ayaka Miyake, Kyoto (JP); Shinya Yamamoto, Kyoto (JP); Daisuke Otsubo, Kyoto (JP)

(73) Assignee: OMRON CORPORATION, Kyoto (JP)

( * ) Notice: Subject to any disclaimer, the term of this patent is extended or adjusted under 35 U.S.C. 154(b) by 195 days.

(21) Appl. No.: 17/496,785

(22) Filed: Oct. 8, 2021

(65) Prior Publication Data

US 2022/0122793 A1 Apr. 21, 2022

(30) Foreign Application Priority Data

Oct. 20, 2020 (JP) ..... 2020-176215

(51) Int. Cl.
*H01H 9/02* (2006.01)
*H01H 50/14* (2006.01)
*H01H 50/02* (2006.01)

(52) U.S. Cl.
CPC ..... *H01H 50/14* (2013.01); *H01H 50/02* (2013.01)

(58) Field of Classification Search
CPC ..... H01H 50/14; H01H 50/02; H01H 50/042; H01H 50/023; H01H 50/045; H01H 50/20; H01H 50/546; H01H 50/641; H01H 50/648; H01H 51/065
USPC ..... 335/10, 8, 21
See application file for complete search history.

(56) References Cited

U.S. PATENT DOCUMENTS 4,616,201 A * 10/1986 Nagamoto ..... H01H 50/14 335/135
5,929,730 A * 7/1999 Hendel ..... H01H 49/00 335/85
6,337,614 B1 * 1/2002 Tsutsui ..... H01H 50/02 335/83
6,483,407 B1 * 11/2002 Matsuda ..... H01H 50/02 335/78
2003/0034863 A1 * 2/2003 Ono ..... H01H 51/20 335/128
2013/0222084 A1 * 8/2013 Kato ..... H01H 50/043 335/189
2013/0285774 A1 * 10/2013 Hasegawa ..... H01H 3/28 335/189

(Continued)

FOREIGN PATENT DOCUMENTS

JP 2016-110844 A 6/2016

*Primary Examiner* — Shawki S Ismail
*Assistant Examiner* — Lisa N Homza
(74) *Attorney, Agent, or Firm* — SHINJYU GLOBAL IP

(57) ABSTRACT

An electromagnetic relay includes a base, a first terminal, a fixing member, and a first adhesive. The base includes a first hole. The base is made of a thermosetting resin. The first terminal extends through the first hole. The fixing member is a separate body from the base. The fixing member has higher elasticity than the thermosetting resin. The fixing member fixes the first terminal to the base. The fixing member includes a first support wall and a first recess. The first support wall is disposed between an inner surface of the first hole and the first terminal. The first support wall extends upward along the first terminal. The first recess is disposed on an upper surface of the first support wall and faces the first terminal. The first adhesive is filled in the first recess. The first adhesive adheres the first terminal and the first support wall.

8 Claims, 13 Drawing Sheets

(56) References Cited

U.S. PATENT DOCUMENTS

| | | | | |
|---|---|---|---|---|
| 2016/0155592 | A1* | 6/2016 | Ito | H01H 50/36<br>335/187 |
| 2017/0092450 | A1* | 3/2017 | Sunohara | H01H 50/24 |
| 2017/0133183 | A1* | 5/2017 | Hasegawa | H01H 50/58 |
| 2017/0309429 | A1 | 10/2017 | Hayashida et al. | |
| 2020/0043687 | A1* | 2/2020 | Kobayashi | H01H 51/29 |
| 2020/0176206 | A1* | 6/2020 | Kubono | H01H 50/54 |
| 2021/0407754 | A1* | 12/2021 | Kitajima | H01H 50/042 |
| 2022/0122793 | A1* | 4/2022 | Miyake | H01H 50/045 |
| 2023/0019139 | A1* | 1/2023 | Murakoshi | H01H 50/041 |

* cited by examiner

ELECTROMAGNETIC RELAY

CROSS-REFERENCE TO RELATED APPLICATION

This application claims priority to Japanese Patent Application No. 2020-176215, filed Oct. 20, 2020. The contents of that application are incorporated by reference herein in their entirety.

FIELD

The present invention relates to an electromagnetic relay.

BACKGROUND

An electromagnetic relay includes a base and a terminal. The base is made of resin, and the base is provided with a hole into which the terminal is inserted. As illustrated in Japan Laid-open Patent Application Publication No. 2016-110844, the terminal is fixed to the base by press fitting.

SUMMARY

In a high-capacity electromagnetic relay, the base is preferably made of a thermosetting resin from the viewpoint of heat resistance. However, when the terminal is fixed to the base made of thermosetting resin by press fitting, the base is likely to be cracked or resin waste is likely to be generated. Therefore, it is difficult to fix the terminal to the base made of thermosetting resin by press fitting. However, if the terminal is fixed to the base without press fitting, the position of the terminal cannot be held stably, and the position of the terminal after assembly will vary. An object of the present disclosure is to provide an electromagnetic relay which has high heat resistance and in which a terminal is stably attached to a base.

An electromagnetic relay according to one aspect of the present disclosure includes a base, a first terminal, a fixing member, and a first adhesive. The base includes a first hole. The base is made of a thermosetting resin. The first terminal extends through the first hole. The fixing member is a separate body from the base. The fixing member has higher elasticity than the thermosetting resin. The fixing member fixes the first terminal to the base. The fixing member includes a first support wall and a first recess.

The first support wall is disposed between an inner surface of the first hole and the first terminal. The first support wall extends upward along the first terminal. The first recess is disposed on an upper surface of the first support wall and faces the first terminal. The first adhesive is filled in the first recess. The first adhesive adheres the first terminal and the first support wall.

In the electromagnetic relay according to the present aspect, the base is made of the thermosetting resin. Therefore, the electromagnetic relay has high heat resistance. Further, the first terminal is fixed to the base by the fixing member. The fixing member has higher elasticity than the thermosetting resin. Therefore, cracking of the base or generation of resin waste can be suppressed. Further, the first terminal and the first support wall are adhered by the first adhesive. Therefore, the first terminal is firmly fixed to the fixing member. In addition, the bounce of the first terminal is suppressed during the operation of the electromagnetic relay.

The base may further include a second hole. The electromagnetic relay may further include a second terminal and a second adhesive. The second terminal may extend through the second hole. The fixing member may further include a second support wall and a second recess. The second support wall may be disposed between an inner surface of the second hole and the second terminal. The second support wall may extend upward along the second terminal. The second recess may be disposed on an upper surface of the second support wall and face the second terminal. The second adhesive may be filled in the second recess. The second adhesive may adhere the second terminal and the second support wall.

In this case, the second terminal is fixed to the base by the fixing member. Therefore, cracking of the base or generation of resin waste can be suppressed. Further, the second terminal and the second support wall are adhered by the second adhesive. Therefore, the second terminal is firmly fixed to the second support wall. Further, the bounce of the second terminal is suppressed during the operation of the electromagnetic relay.

The fixing member may further include a link portion. The link portion may connect the first support wall and the second support wall. The first support wall, the link portion, and the second support wall may be integrally formed with each other. In this case, the number of parts is reduced.

The second adhesive may be harder than the fixing member. In this case, the bounce of the second terminal is further suppressed. The first adhesive may be harder than the fixing member. In this case, the bounce of the first terminal is further suppressed.

The base may further include an opening adjacent to the first hole. The fixing member may be disposed in the opening by press fitting. The fixing member may further include a plurality of protrusions. The plurality of protrusions may be disposed in the opening and be in contact with the base. In this case, the first terminal is stably fixed to the base by press fitting of the fixing member while preventing the base from cracking.

The protrusions extend in a vertical direction and may include a curved tip. In this case, the protrusions contact the base by line contact. Therefore, the protrusions are more likely to be elastically deformed than when the protrusions contact the base by surface contact. As a result, cracking in the base is further suppressed.

The base may include a notch. The notch may be disposed on an edge of the first hole. In this case, the first terminal can be temporarily fixed to the base by filling the notch with an adhesive. As a result, the ease of assembling of the electromagnetic relay is improved.

DETAILED DESCRIPTION

Figure 1:
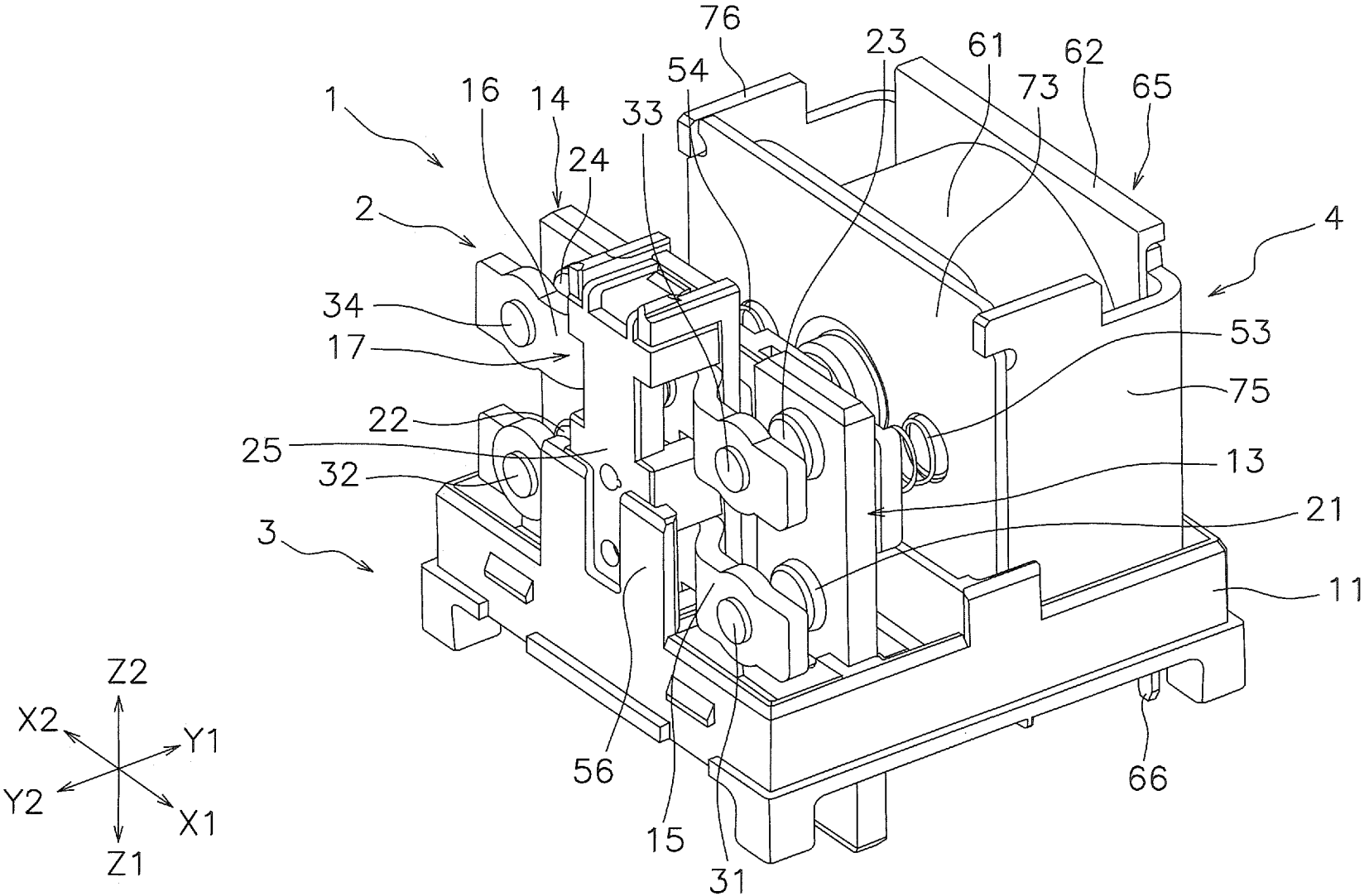
FIG. 1 is a perspective view of an electromagnetic relay according to an embodiment.
Figure 2:
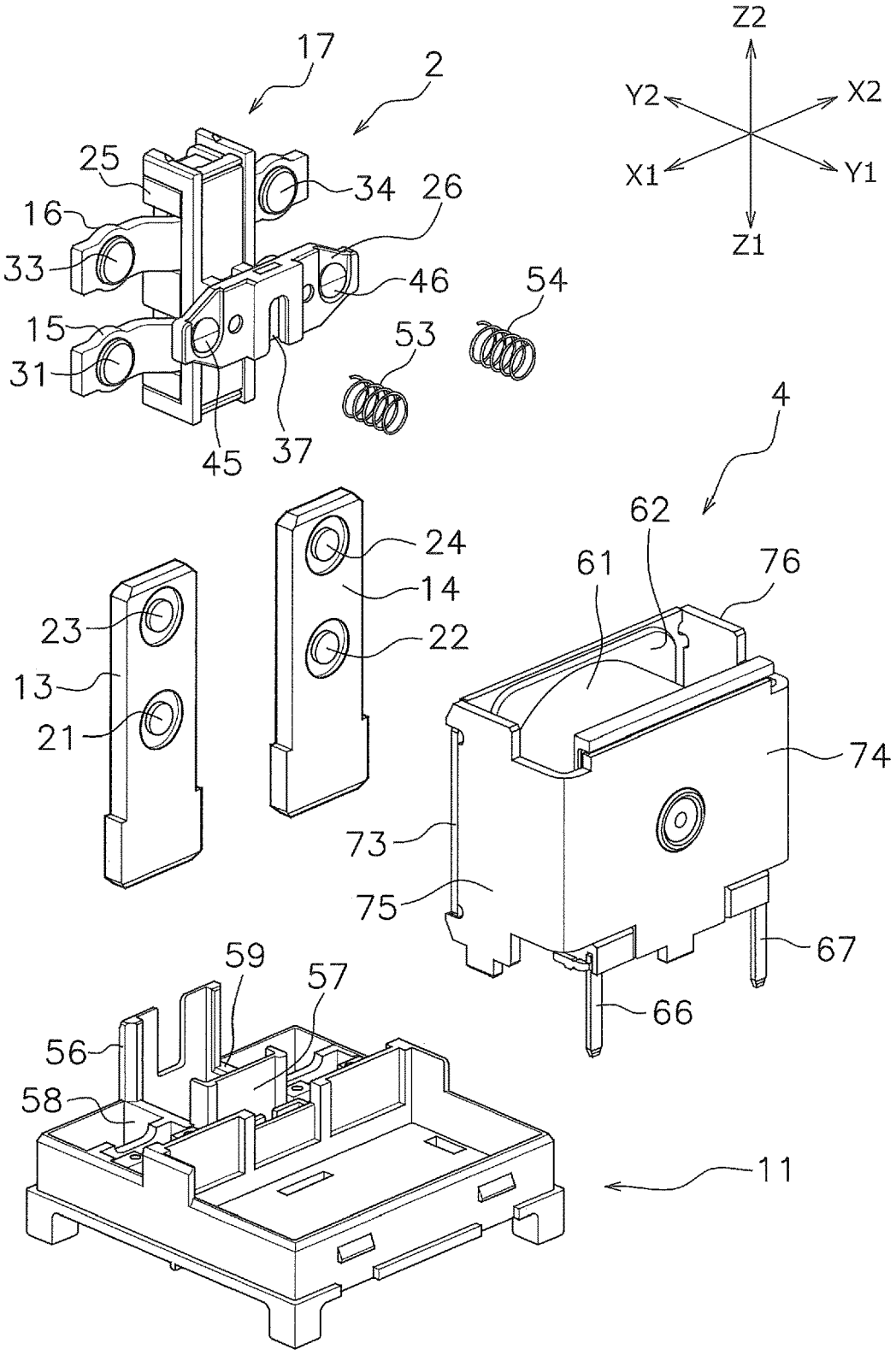
FIG. 2 is an exploded perspective view of the electromagnetic relay.
Figure 3:
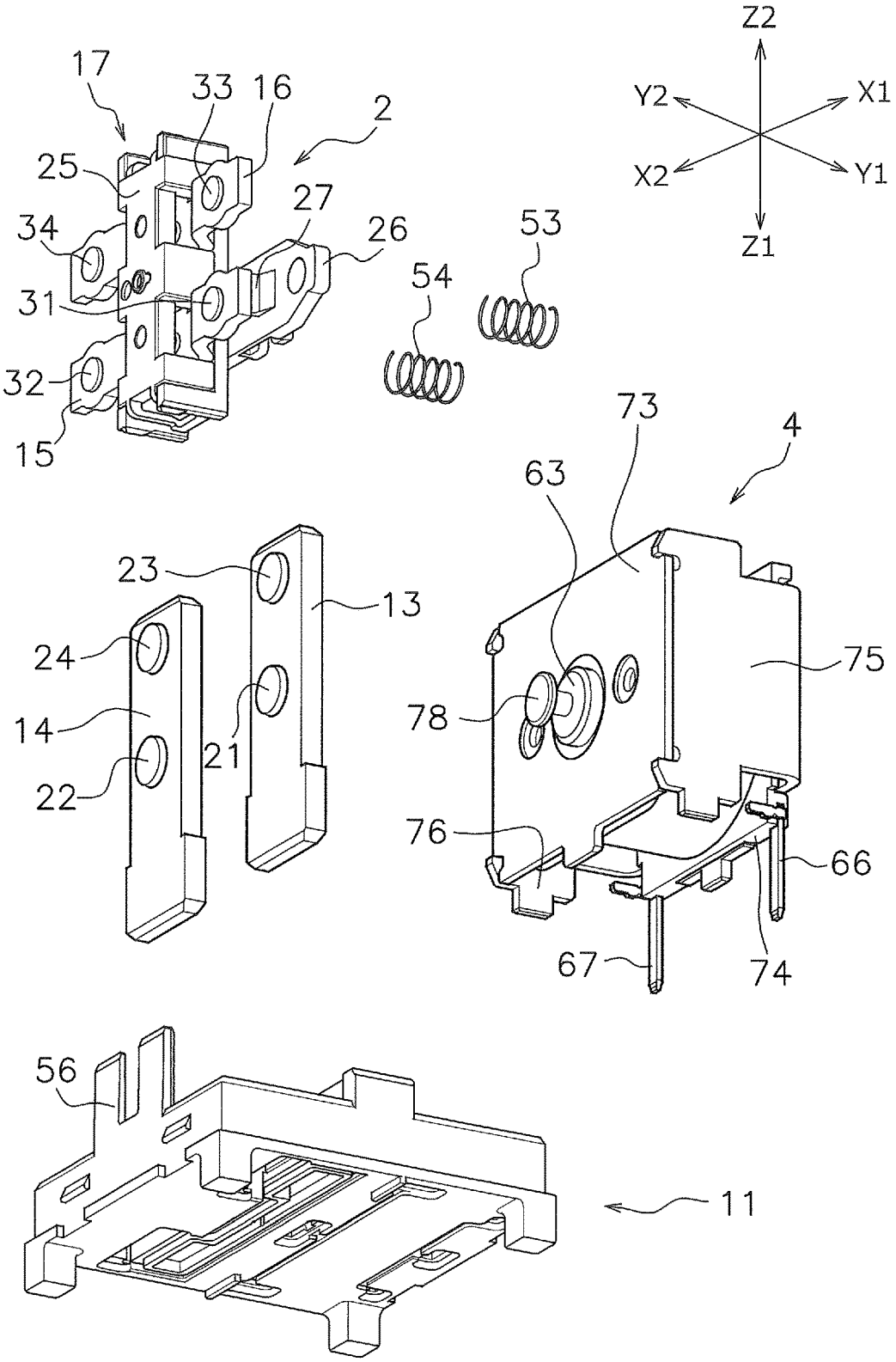
FIG. 3 is an exploded perspective view of the electromagnetic relay.
Figure 4:
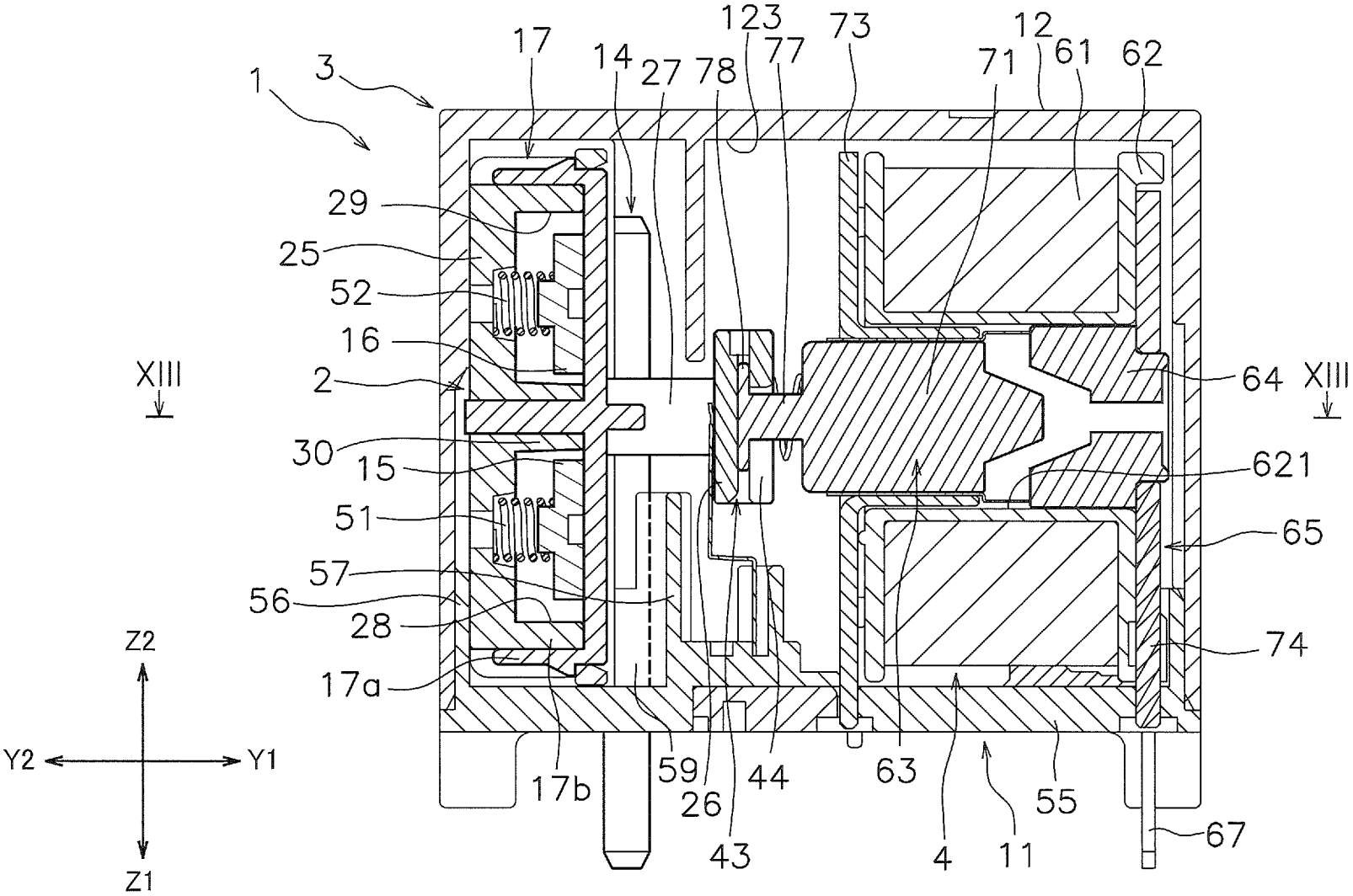
FIG. 4 is a vertical cross-sectional view of the electromagnetic relay.
Figure 5:
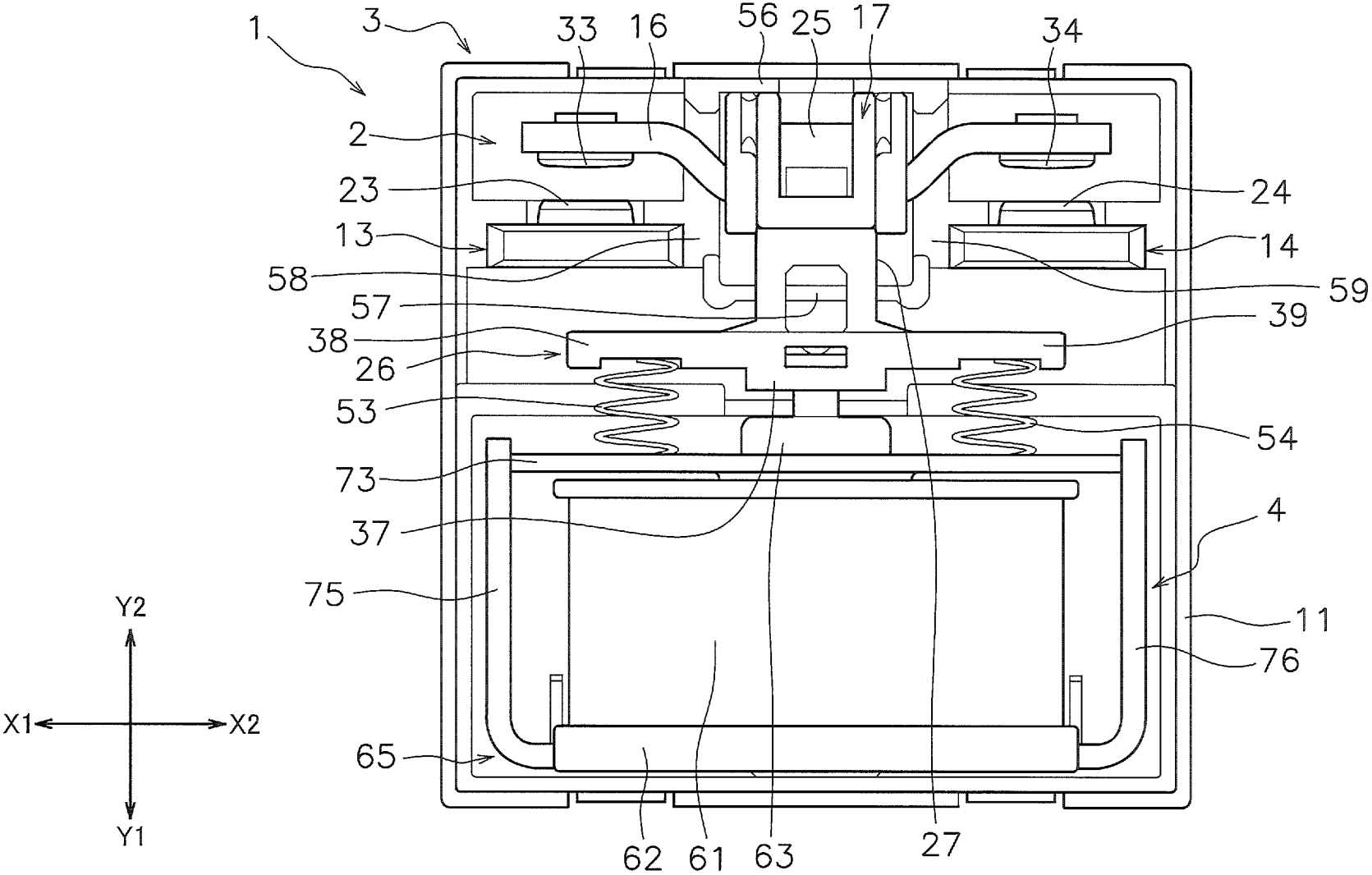
FIG. 5 is a top view of the electromagnetic relay when a moving member is in an open position.
Figure 6:
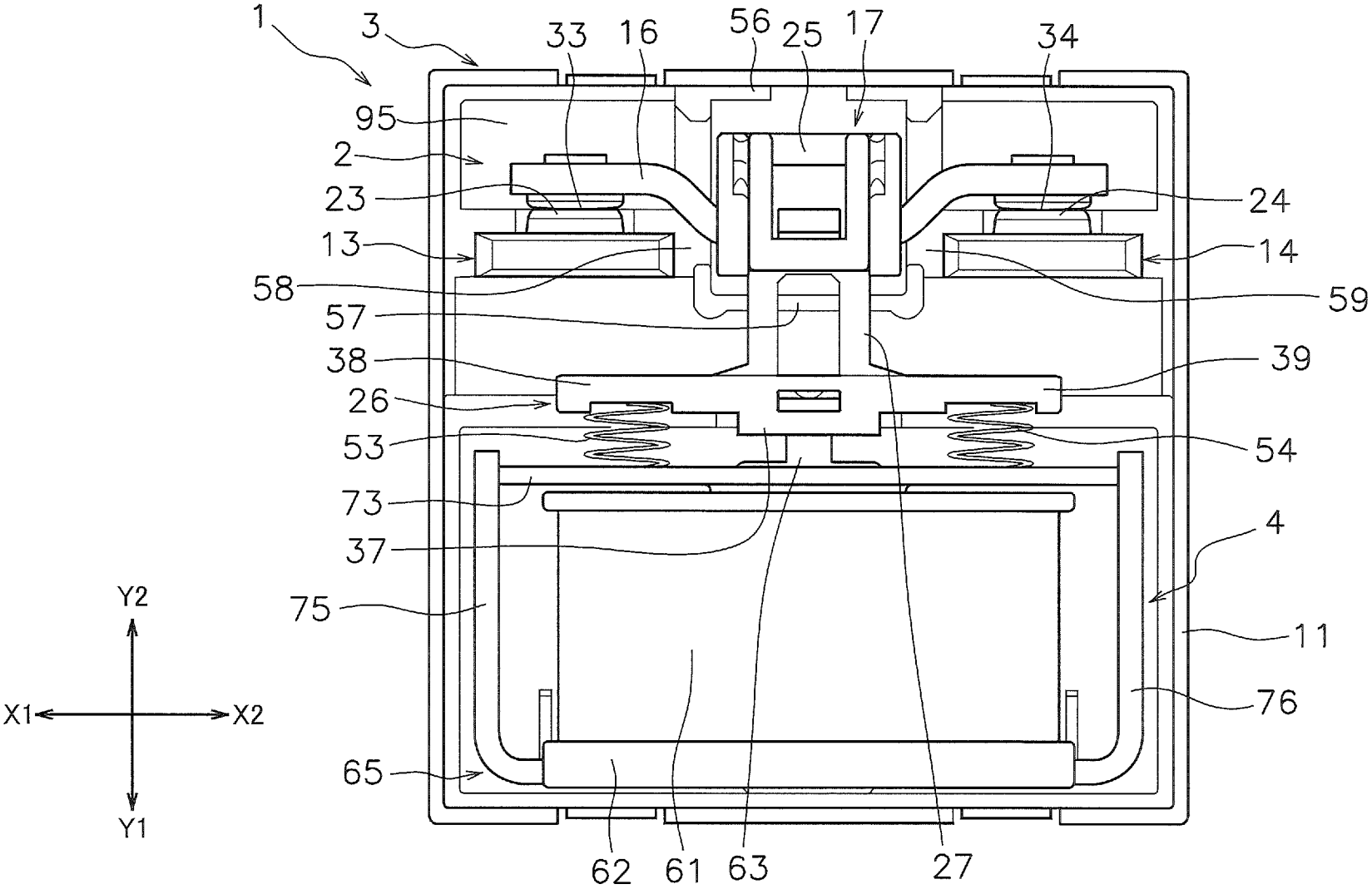
FIG. 6 is a top view of the electromagnetic relay when the moving member is in a closed position.

Hereinafter, an electromagnetic relay 1 according to an embodiment will be described with reference to the drawings. FIG. 1 is a perspective view of the electromagnetic relay 1 according to the embodiment. FIGS. 2 and 3 are exploded perspective views of the electromagnetic relay 1. FIG. 4 is a vertical cross-sectional view of the electromagnetic relay 1. FIGS. 5 and 6 are top views of the electromagnetic relay 1.

The electromagnetic relay 1 includes a contact block 2, a housing 3, a coil block 4, a first fixed terminal 13, and a second fixed terminal 14. The contact block 2 and the coil block 4 are disposed in the housing 3. The housing 3 includes a base 11 and a case 12. The base 11 and the case 12 are made of, for example, resin. In FIG. 1, the case 12 is omitted. The base 11 supports the first fixed terminal 13, the second fixed terminal 14, the contact block 2, and the coil block 4.

In the present embodiment, a moving direction (Y1, Y2), a support direction (Z1, Z2), and a lateral direction (X1, X2) are defined as follows. The moving direction (Y1, Y2) is a direction in which the contact block 2 and the coil block 4 are aligned with each other. The moving direction (Y1, Y2) includes a first moving direction (Y1) and a second moving direction (Y2). The first moving direction (Y1) is a direction from the contact block 2 toward the coil block 4. The second moving direction (Y2) is a direction opposite to the first moving direction (Y1). The second moving direction (Y2) is a direction from the coil block 4 toward the contact block 2.

The support direction (Z1, Z2) is a direction perpendicular to the moving direction (Y1, Y2). The support direction (Z1, Z2) is a direction in which the base 11 and the contact block 2 are aligned with each other. The support direction (Z1, Z2) includes a first support direction (Z1) and a second support direction (Z2). The first support direction (Z1) is a direction from the contact block 2 toward the base 11. The second support direction (Z2) is a direction opposite to the first support direction (Z1). The second support direction (Z2) is a direction from the base 11 toward the contact block 2. Alternatively, the support direction (Z1, Z2) may be a direction in which the base 11 and the coil block 4 are aligned with each other.

The lateral direction (X1, X2) is a direction perpendicular to the moving direction (Y1, Y2) and the support direction (Z1, Z2). The lateral direction (X1, X2) includes a first lateral direction (X1) and a second lateral direction (X2). The second lateral direction (X2) is a direction opposite to the first lateral direction (X1).

The first fixed terminal 13 and the second fixed terminal 14 are made of a conductive material such as copper. The first fixed terminal 13 and the second fixed terminal 14 extend in the support direction (Z1, Z2), respectively. The first fixed terminal 13 and the second fixed terminal 14 are disposed apart from each other in the lateral direction (X1, X2). The first fixed terminal 13 is fixed to the base 11. A tip of the first fixed terminal 13 projects outward from the base 11. The second fixed terminal 14 is fixed to the base 11. A tip of the second fixed terminal 14 projects outward from the base 11.

The first fixed contact 21 and the third fixed contact 23 are connected to the first fixed terminal 13. The first fixed contact 21 and the third fixed contact 23 are disposed apart from each other in the support direction (Z1, Z2) on the first fixed terminal 13. The second fixed contact 22 and the fourth fixed contact 24 are connected to the second fixed terminal 14. The second fixed contact 22 and the fourth fixed contact 24 are disposed apart from each other in the support direction (Z1, Z2) on the second fixed terminal 14. The first to fourth fixed contacts 21 to 24 are made of a conductive material such as silver or copper.

The contact block 2 includes a first movable contact piece 15, a second movable contact piece 16, and a moving member 17. The first movable contact piece 15 and the second movable contact piece 16 extend in the lateral direction (X1, X2). The first movable contact piece 15 and the second movable contact piece 16 are separate bodies from each other. The first movable contact piece 15 and the second movable contact piece 16 are disposed apart from each other in the support direction (Z1, Z2). The first movable contact piece 15 is disposed between the second movable contact piece 16 and the base 11 in the support direction (Z1, Z2). The first movable contact piece 15 and the second movable contact piece 16 are made of a conductive material such as copper.

The first movable contact 31 and the second movable contact 32 are connected to the first movable contact piece 15. The first movable contact 31 and the second movable contact 32 are disposed apart from each other in the lateral direction (X1, X2). The first movable contact 31 is disposed to face the first fixed contact 21. The second movable contact 32 is disposed to face the second fixed contact 22.

The third movable contact 33 and the fourth movable contact 34 are connected to the second movable contact piece 16. The third movable contact 33 and the fourth movable contact 34 are disposed apart from each other in the lateral direction (X1, X2). The third movable contact 33 is disposed to face the third fixed contact 23. The fourth movable contact 34 is disposed to face the fourth fixed contact 24. The first to fourth movable contacts 31 to 34 are made of a conductive material such as silver or copper.

The moving member 17 holds the first movable contact piece 15 and the second movable contact piece 16. The moving member 17 is made of resin having electrical insulation. The moving member 17 is supported by the housing 3 in the support direction (Z1, Z2). The moving member 17 is slidable in the moving direction (Y1, Y2) with respect to the housing 3. The moving member 17 is configured to move between a closed position and an open position. In FIG. 5, the moving member 17 is located at the open position. When the moving member 17 is located at the open position, the movable contacts 31 to 34 are separated from the fixed contacts 21 to 24, respectively. In FIG. 6, the moving member 17 is located at the closed position. When the moving member 17 is located in the closed position, the movable contacts 31 to 34 contact the fixed contacts 21 to 24, respectively.

The coil block 4 moves the first movable contact piece 15 and the second movable contact piece 16 by an electromagnetic force. The coil block 4 moves the first movable contact piece 15 and the second movable contact piece 16 in the first moving direction (Y1) and the second moving direction (Y2). The first moving direction (Y1) is a direction in which the movable contacts 31 to 34 contact the fixed contact 21 to 24 in the moving direction (Y1, Y2). The second moving direction (Y2) is a direction in which the movable contacts 31 to 34 are separated from the fixed contacts 21 to 24 in the moving direction (Y1, Y2). The coil block 4 includes a coil 61, a spool 62, a movable iron core 63, a fixed iron core 64, and a yoke 65.

The coil 61 is wound around the spool 62. An axis of the coil 61 extends in the moving direction (Y1, Y2). The coil 61 is connected to the coil terminals 66 and 67. As illustrated in FIGS. 2 and 3, the coil terminals 66 and 67 project from the coil block 4 in the first support direction (Z1). The coil terminals 66 and 67 project outward from the base 11.

As illustrated in FIG. 4, the spool 62 includes a spool hole 621 extending in the moving direction (Y1, Y2). At least a part of the movable iron core 63 is disposed in the spool hole 621 of the spool 62. The movable iron core 63 is configured to move in the first moving direction (Y1) and the second moving direction (Y2). The fixed iron core 64 is disposed in the spool hole 621 of the spool 62. The fixed iron core 64 is disposed to face the movable iron core 63 in the moving direction (Y1, Y2). The coil 61 generates an electromagnetic force that moves the movable iron core 63 in the first moving direction (Y1) by being energized.

The movable iron core 63 is connected to the moving member 17. The first movable contact piece 15 and the movable iron core 63 are electrically insulated by the moving member 17. The second movable contact piece 16 and the movable iron core 63 are electrically insulated by the moving member 17. The movable iron core 63 moves integrally with the moving member 17 in the moving direction (Y1, Y2). The movable iron core 63 moves in the first moving direction (Y1) according to the magnetic force generated from the coil 61. With the movement of the movable iron core 63, the moving member 17 moves to the closed position. As the moving member 17 moves, the first movable contact piece 15 and the second movable contact piece 16 move in the first moving direction (Y1) or the second moving direction (Y2).

The yoke 65 is disposed so as to surround the coil 61. The yoke 65 is disposed on a magnetic circuit generated by the coil 61. The yoke 65 includes a first yoke 73, a second yoke 74, a third yoke 75, and a fourth yoke 76. The first yoke 73 and the second yoke 74 extend in the lateral direction (X1, X2) and the support direction (Z1, Z2). The first yoke 73 and the second yoke 74 face the coil 61 in the moving direction (Y1, Y2). The coil 61 is located between the first yoke 73 and the second yoke 74 in the moving direction (Y1, Y2). The second yoke 74 is connected to the fixed iron core 64.

The third yoke 75 and the fourth yoke 76 extend in the moving direction (Y1, Y2) and the support direction (Z1, Z2). The third yoke 75 and the fourth yoke 76 face the coil 61 in the lateral direction (X1, X2). The coil 61 is located between the third yoke 75 and the fourth yoke 76 in the lateral direction (X1, X2).

Figure 7:
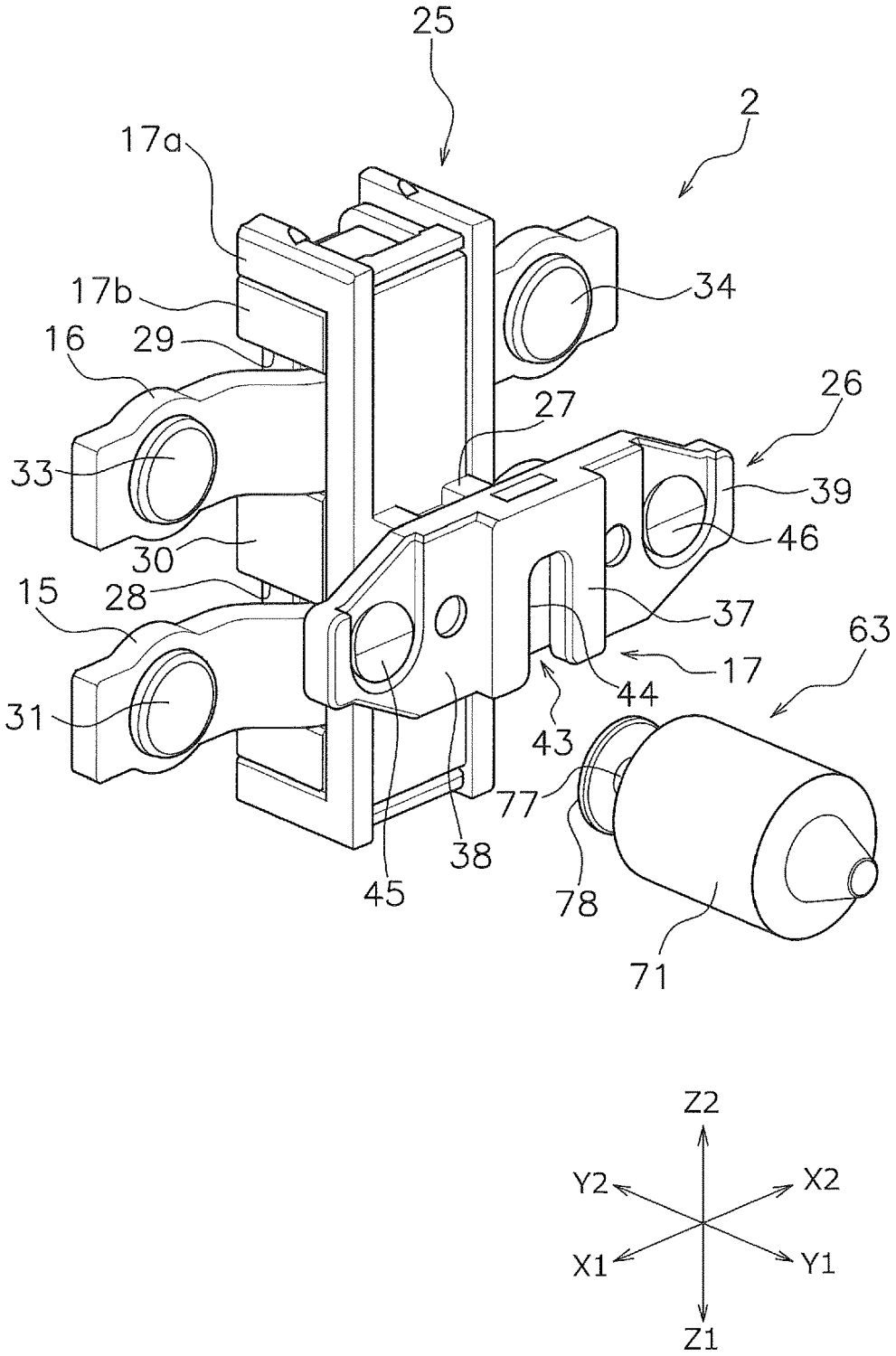
FIG. 7 is a perspective view of the moving member and its surroundings.

FIG. 7 is a perspective view of the moving member 17 and its surroundings. The moving member 17 includes a support portion 25, a connecting portion 26, and a link portion 27. The support portion 25 supports the first movable contact piece 15 and the second movable contact piece 16. The connecting portion 26 is connected to the movable iron core 63. The link portion 27 is located between the support portion 25 and the connecting portion 26. The link portion 27 connects the support portion 25 and the connecting portion 26. The link portion 27 is connected to a central portion of the support portion 25 in the support direction (Z1, Z2). The link portion 27 is connected to the support portion 25 at a position between the first movable contact piece 15 and the second movable contact piece 16 in the support direction (Z1 and Z2). The link portion 27 extends in the moving direction (Y1, Y2).

The support portion 25 extends in the support direction (Z1, Z2). The support portion 25 extends from the first movable contact piece 15 toward the base 11 in the first support direction (Z1). As illustrated in FIG. 4, the support portion 25 extends from the second movable contact piece 16 toward a top surface 123 of the case 12 in the second support direction (Z2). The support portion 25 includes a first support hole 28, a second support hole 29, and a partition wall 30. The first movable contact piece 15 is disposed in the first support hole 28. The first movable contact piece 15 is supported by the support portion 25 between the first movable contact 31 and the second movable contact 32. The first movable contact piece 15 extends from the support portion 25 in the first lateral direction (X1) and the second lateral direction (X2).

The second movable contact piece 16 is disposed in the second support hole 29. The second movable contact piece 16 is supported by the support portion 25 between the third movable contact 33 and the fourth movable contact 34. The second movable contact piece 16 extends from the support portion 25 in the first lateral direction (X1) and the second lateral direction (X2). The partition wall 30 partitions the first support hole 28 and the second support hole 29. The partition wall 30 is disposed between the first movable contact piece 15 and the second movable contact piece 16.

As illustrated in FIGS. 2 and 4, the base 11 includes a bottom surface 55, a first wall 56, a second wall 57, a third wall 58, and a fourth wall 59. The bottom surface 55 supports the contact block 2 and the coil block 4 in the support direction (Z1, Z2). The bottom surface 55 is located in the first support direction (Z1) with respect to the contact block 2 and the coil block 4. The first wall 56, the second wall 57, the third wall 58, and the fourth wall 59 extend from the bottom surface 55 in the second support direction (Z2).

The first wall 56 and the second wall 57 are disposed apart from each other in the moving direction (Y1, Y2). The first wall 56 and the second wall 57 face the support portion 25 of the moving member 17 in the moving direction (Y1, Y2). The support portion 25 is located between the first wall 56 and the second wall 57 in the moving direction (Y1, Y2). The first wall 56 and the second wall 57 extend in the lateral direction (X1, X2). The third wall 58 and the fourth wall 59 face the support portion 25 in the lateral direction (X1, X2). The support portion 25 is located between the first wall 56 and the second wall 57 in the lateral direction (X1, X2). The third wall 58 and the fourth wall 59 extend in the moving direction (Y1, Y2).

The moving member 17 includes a first member 17*a* and a second member 17*b*. The first member 17*a* and the second member 17*b* are separate bodies from each other. The second member 17*b* is connected to the first member 17*a* by snap fitting. The first support hole 28 and the second support hole 29 are provided between the first member 17*a* and the second member 17*b*. The first movable contact piece 15 and the second movable contact piece 16 are held between the first member 17*a* and the second member 17*b* in the moving direction (Y1, Y2). The first member 17*a* is connected to the link portion 27. The first member 17*a* is integrally formed with the link portion 27 and the connecting portion 26.

As illustrated in FIG. 4, the contact block 2 includes a first contact spring 51 and a second contact spring 52. The first contact spring 51 is disposed between the first movable contact piece 15 and the support portion 25. The first contact spring 51 is disposed in the first support hole 28. In a state where the first movable contact 31 is in contact with the first fixed contact 21 and the second movable contact 32 is in contact with the second fixed contact 22, the first contact spring 51 presses the first movable contact piece 15 toward the first fixed terminal 13 and the second fixed terminal 14. The first contact spring 51 is a coil spring, and is in a state of natural length when the moving member 17 is located in the open position. The first movable contact piece 15 is connected to the moving member 17 via the first contact spring 51.

The second contact spring 52 is disposed between the second movable contact piece 16 and the support portion 25. The second contact spring 52 is disposed in the second support hole 29. In a state where the third movable contact 33 is in contact with the third fixed contact 23 and the fourth movable contact 34 is in contact with the fourth fixed contact 24, the second contact spring 52 presses the second movable contact piece 16 toward the first fixed terminal 13 and the second fixed terminal 14. The second contact spring 52 is a coil spring, and is in a state of natural length when the moving member 17 is located in the open position. The second movable contact piece 16 is connected to the moving member 17 via the second contact spring 52.

The connecting portion 26 extends in the lateral direction (X1, X2). As illustrated in FIG. 7, the connecting portion 26 includes a core connector 37, a first mount 38, and a second mount 39. The core connector 37 is located between the first mount 38 and the second mount 39. The core connector 37 is connected to the link portion 27. As illustrated in FIGS. 4 and 7, the core connector 37 includes a hole 43 and a locking groove 44. The hole 43 extends in the support direction (Z1, Z2). The hole 43 is opened toward the first support direction (Z1). The locking groove 44 communicates with the hole 43 and extends in the second support direction (Z2). A width of the locking groove 44 is narrower than a width of the hole 43.

The movable iron core 63 includes a tubular portion 71, a shaft portion 77, and a head portion 78. The shaft portion 77 projects from the tubular portion 71 toward the moving member 17. An outer diameter of the shaft portion 77 is smaller than an outer diameter of the tubular portion 71. An outer diameter of the head portion 78 is larger than the outer diameter of the shaft portion 77. The outer diameter of the head portion 78 is larger than the width of the locking groove 44. The shaft portion 77 is disposed in the locking groove 44. The head portion 78 is disposed in the hole 43.

As illustrated in FIG. 7, the first mount 38 extends from the core connector 37 in the first lateral direction (X1). The first mount 38 includes a first protrusion 45. The first protrusion 45 projects from the first mount 38 toward the coil block 4. The second mount 39 extends from the core connector 37 in the second lateral direction (X2). The second mount 39 includes a second protrusion 46. The second protrusion 46 projects from the second mount 39 toward the coil block 4.

The electromagnetic relay 1 includes a first return spring 53 and a second return spring 54. The first return spring 53 and the second return spring 54 are disposed between the moving member 17 and the coil block 4. The first return spring 53 is located in the first lateral direction (X1) with respect to the core connector 37. The second return spring 54 is located in the second lateral direction (X2) with respect to the core connector 37. In other words, the core connector 37 is located between the first return spring 53 and the second return spring 54 in the lateral direction (X1, X2). The first return spring 53 and the second return spring 54 urge the moving member 17 in the second moving direction (Y2). The first return spring 53 is attached to the first protrusion 45. The second return spring 54 is attached to the second protrusion 46.

Next, the operation of the electromagnetic relay 1 will be described. When the coil 61 is not energized, the coil block 4 is not excited. In this case, the moving member 17 is pressed in the second moving direction (Y2) by the elastic force of the return springs 53 and 54 together with the movable iron core 63, and the moving member 17 is located at the open position illustrated in FIG. 5. In this state, the first movable contact piece 15 and the second movable contact piece 16 are also pressed in the second moving direction (Y2) via the moving member 17. Therefore, when the moving member 17 is located at the open position, the first movable contact 31 and the second movable contact 32 are separated from the first fixed contact 21 and the second fixed contact 22. Similarly, when the moving member 17 is located at the open position, the third movable contact 33 and the fourth movable contact 34 are separated from the third fixed contact 23 and the fourth fixed contact 24.

When the coil 61 is energized, the coil block 4 is magnetized. In this case, due to the electromagnetic force of the coil 61, the movable iron core 63 moves in the first moving direction (Y1) against the elastic force of the return springs 53 and 54. As a result, the moving member 17, the first movable contact piece 15, and the second movable contact piece 16 move in the first moving direction (Y1). Therefore, as illustrated in FIG. 6, the moving member 17 moves to the closed position. As a result, when the moving member 17 is located in the closed position, the first movable contact 31 and the second movable contact 32 contact the first fixed contact 21 and the second fixed contact 22, respectively. Similarly, when the moving member 17 is located in the closed position, the third movable contact 33 and the fourth movable contact 34 contact the third fixed contact 23 and the fourth fixed contact 24, respectively. As a result, the first movable contact piece 15 and the second movable contact piece 16 are electrically connected to the first fixed terminal 13 and the second fixed terminal 14.

When the current to the coil 61 is stopped and degaussed, the movable iron core 63 is pressed in the second moving direction (Y2) by the elastic force of the return springs 53 and 54. As a result, the moving member 17, the first movable contact piece 15, and the second movable contact piece 16 move in the second moving direction (Y2). Therefore, as illustrated in FIG. 5, the moving member 17 moves to the open position. As a result, when the moving member 17 is located at the open position, the first movable contact 31 and the second movable contact 32 are separated from the first fixed contact 21 and the second fixed contact 22. Similarly, when the moving member 17 is located in the open position, the third movable contact 33 and the fourth movable contact 34 are separated from the third fixed contact 23 and the fourth fixed contact 24.

Figure 8:
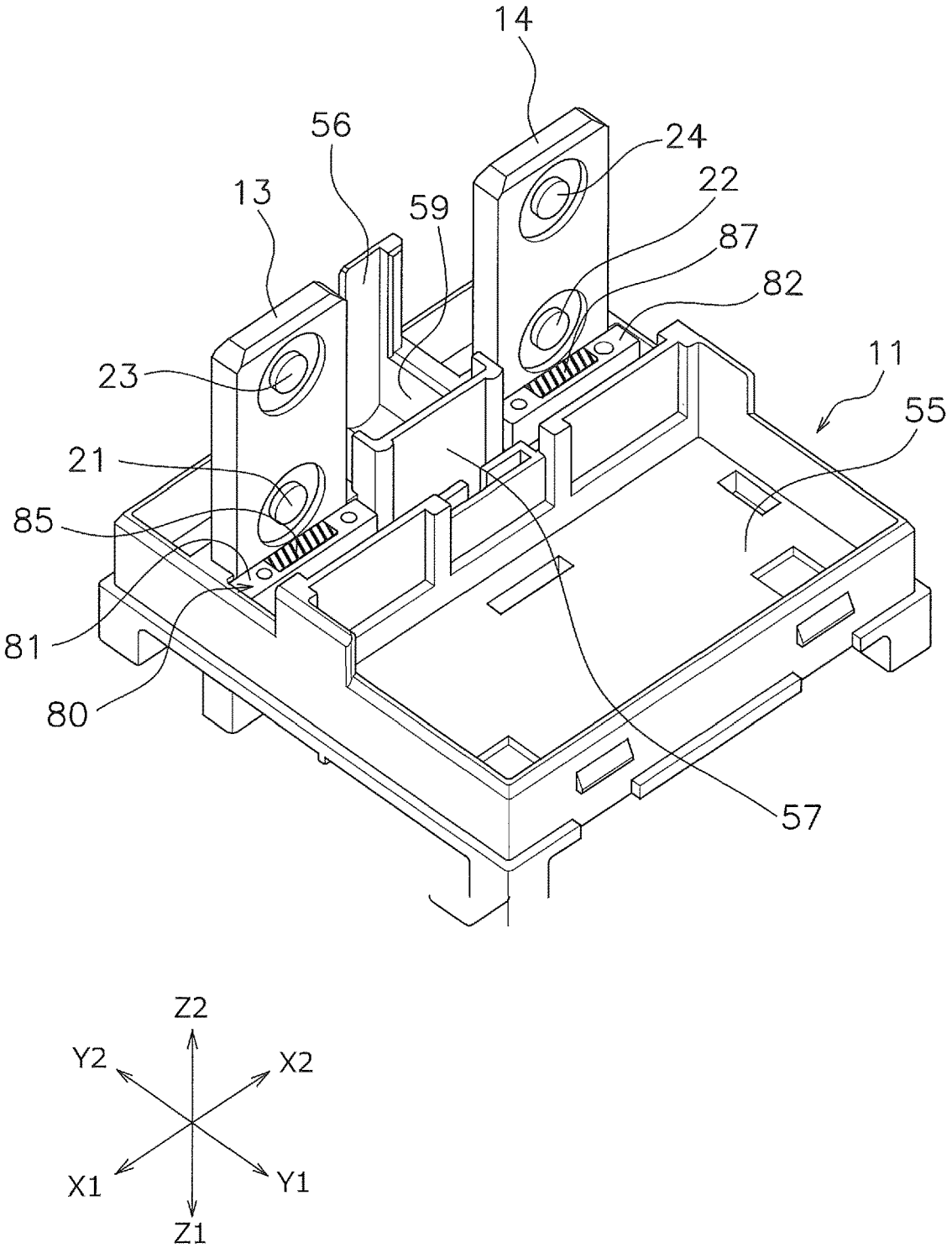
FIG. 8 is a perspective view of a base and first and second fixed terminals.
Figure 9:
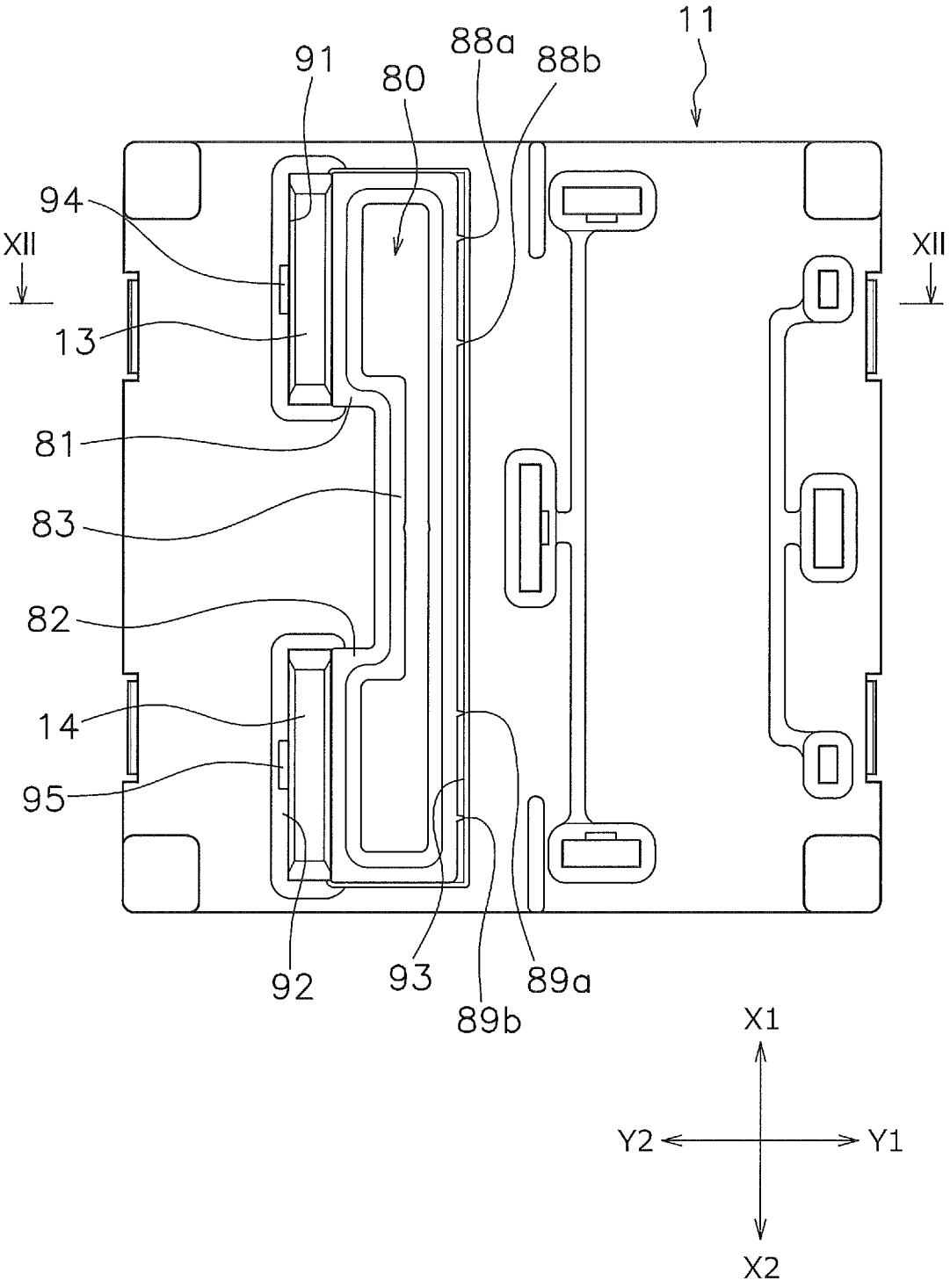
FIG. 9 is a bottom view of the base and the first and second fixed terminals.

Next, the structure of fixing the first and second fixed terminals 13 and 14 to the base 11 will be described. FIG. 8 is a perspective view of the base 11 and the first and second fixed terminals 13 and 14. FIG. 9 is a bottom view of the base 11 and the first and second fixed terminals 13 and 14. In the following description, the downward direction means the first support direction (Z1). The upward direction means the second support direction (Z2). As illustrated in FIGS. 8 and 9, the electromagnetic relay 1 includes a fixing member 80. The first and second fixed terminals 13 and 14 are fixed to the base 11 by the fixing member 80. The base 11 is made of a thermosetting resin such as a phenol resin.

Figure 10:
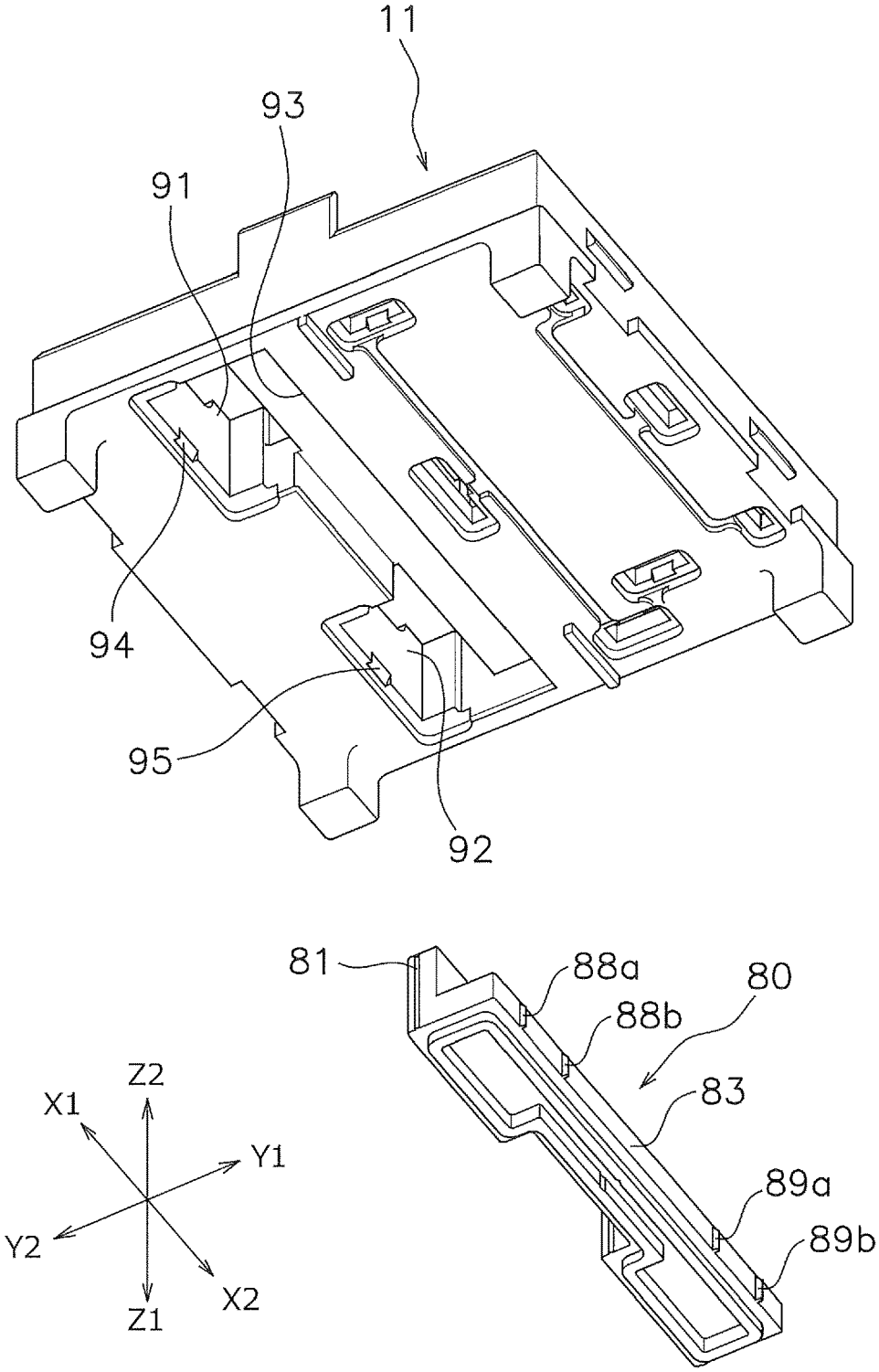
FIG. 10 is an exploded view of the base and a fixing member.
Figure 11:
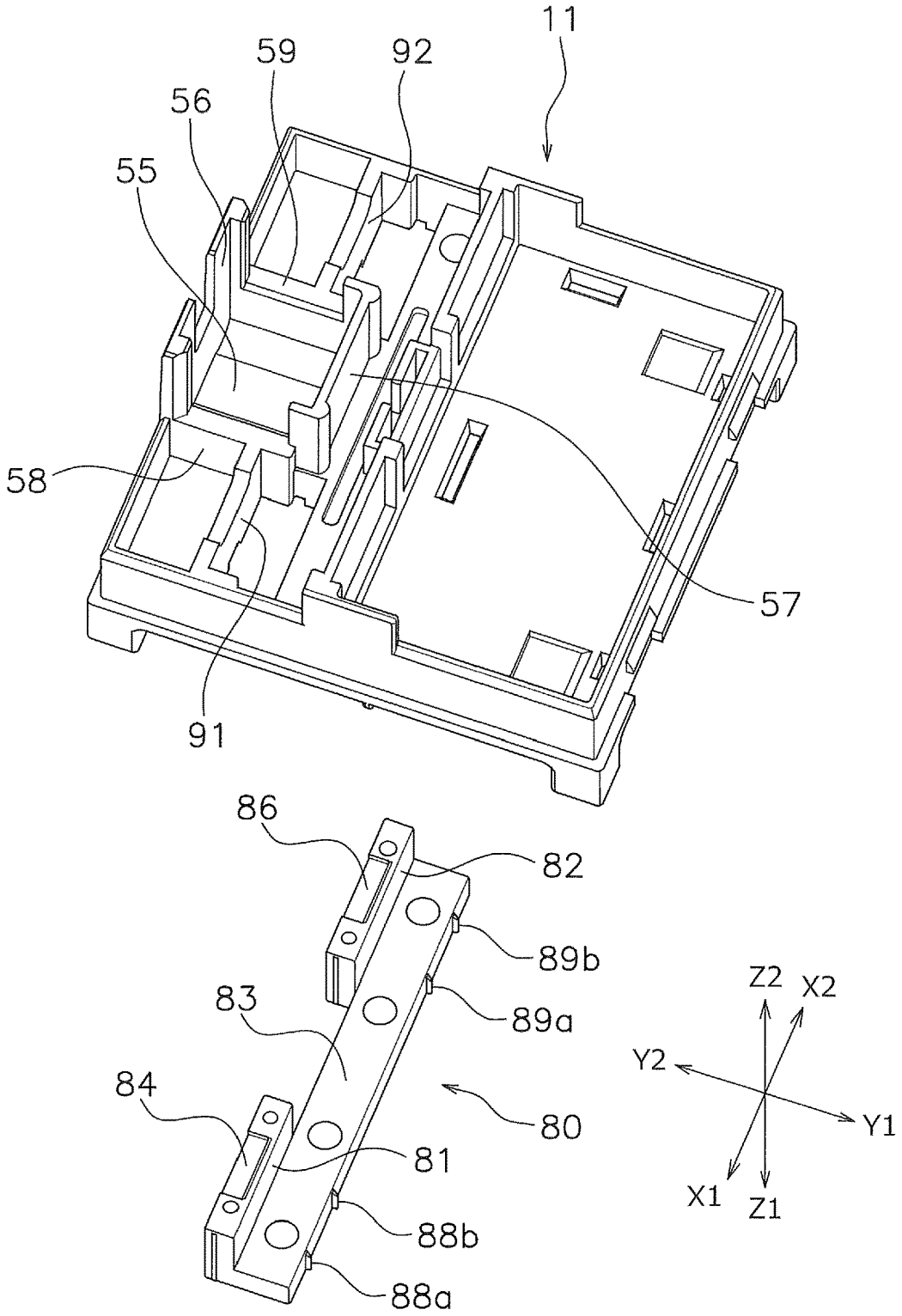
FIG. 11 is an exploded view of the base and the fixing member.
Figure 12:
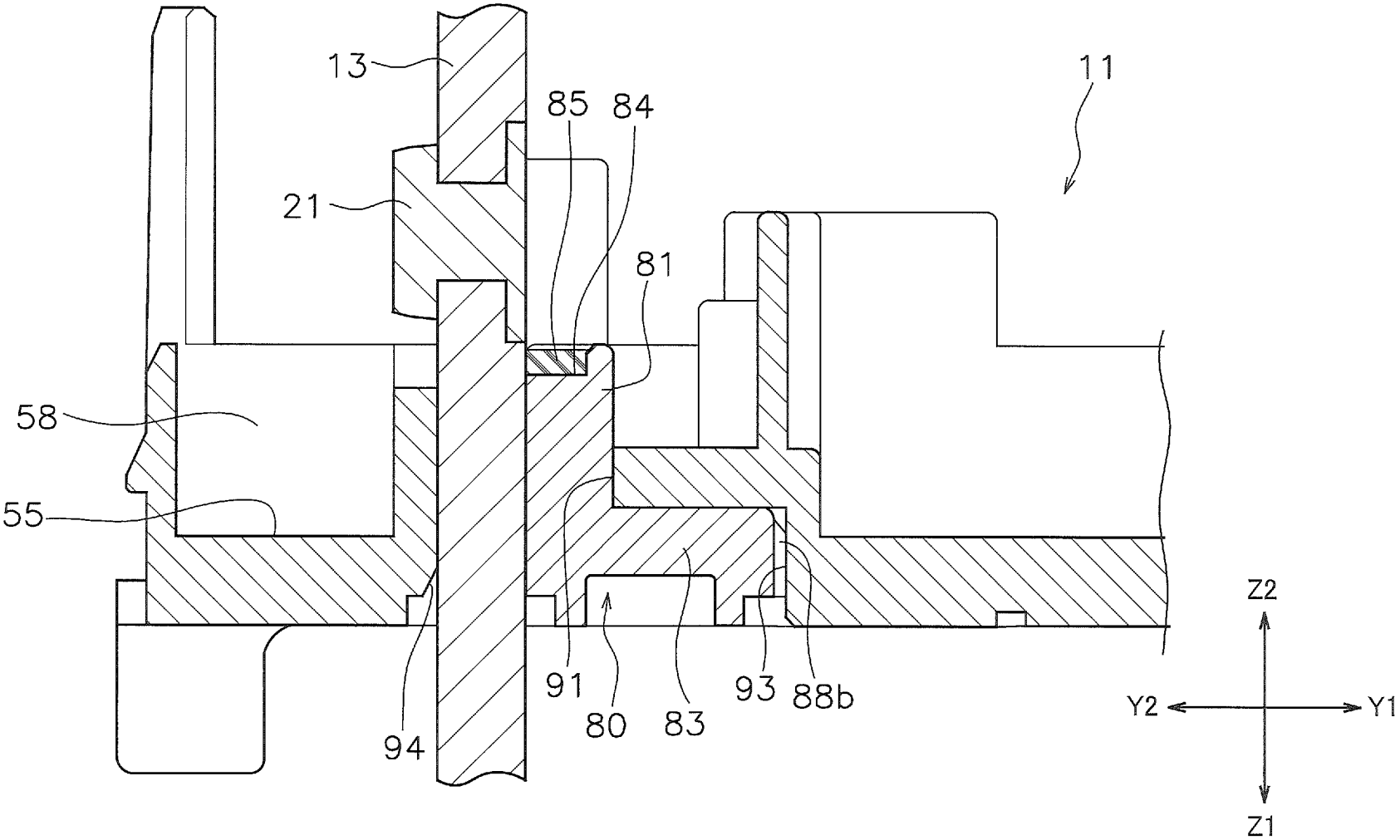
FIG. 12 is a cross-sectional view taken along the line XII-XII in FIG. 9.

FIGS. 10 and 11 are exploded views of the base 11 and the fixing member 80. FIG. 12 is a cross-sectional view taken along the line XII-XII in FIG. 9. As illustrated in FIGS. 10 and 11, the base 11 includes a first hole 91, a second hole 92, and an opening 93. The first hole 91 and the second hole 92 penetrate the base 11 in the vertical direction. The opening 93 is adjacent to the first hole 91 and the second hole 92. As illustrated in FIG. 9, the first fixed terminal 13 is disposed in the first hole 91. The first fixed terminal 13 extends through the first hole 91. The second fixed terminal 14 is disposed in the second hole 92. The second fixed terminal 14 extends through the second hole 92. The opening 93 is disposed on the lower surface of the base 11. The opening 93 is adjacent to the first hole 91 and the second hole 92.

The fixing member 80 is a separate body from the base 11. The fixing member 80 is made of a material having higher elasticity than the thermosetting resin. The fixing member 80 is made of nylon, for example. The fixing member 80 fixes the first fixed terminal 13 and the second fixed terminal 14 to the base 11. As illustrated in FIG. 11, the fixing member 80 includes a first support wall 81, a second support wall 82, and a link portion 83. The first support wall 81, the link portion 83, and the second support wall 82 are integrally formed with each other.

The first support wall 81 extends upward from the link portion 83. The first support wall 81 extends upward along the first fixed terminal 13. The first support wall 81 is disposed between the inner surface of the first hole 91 and the first fixed terminal 13. The upper surface of the first support wall 81 is located above the bottom surface 55 of the base 11. A first recess 84 is disposed on the upper surface of the first support wall 81. The first recess 84 faces the first fixed terminal 13. The first recess 84 is open toward the first fixed terminal 13.

As illustrated in FIGS. 8 and 12, the first recess 84 is filled with a first adhesive 85. In FIG. 8, the first adhesive 85 is hatched for easy understanding. The first adhesive 85 is solidified and adheres the first support wall 81 and the first fixed terminal 13. The first adhesive 85 is made of a material harder than the fixing member 80. That is, the first adhesive 85 has a higher rigidity than the fixing member 80. The first adhesive 85 is, for example, an epoxy resin-based adhesive.

The second support wall 82 is aligned with the first support wall 81 in the lateral direction (X1, X2). The second support wall 82 extends upward from the link portion 83. The second support wall 82 extends upward along the second fixed terminal 14. The second support wall 82 is disposed between the inner surface of the second hole 92 and the second fixed terminal 14. The upper surface of the second support wall 82 is located above the bottom surface 55 of the base 11. A second recess 86 is disposed on the upper surface of the second support wall 82. The second recess 86 faces the second fixed terminal 14. The second recess 86 is open toward the second fixed terminal 14.

The second recess 86 is filled with a second adhesive 87. In FIG. 8, the second adhesive 87 is hatched for easy understanding. The second adhesive 87 is solidified and adheres the second support wall 82 and the second fixed terminal 14. The second adhesive 87 is made of a material harder than the fixing member 80. That is, the second adhesive 87 has a higher rigidity than the fixing member 80. The second adhesive 87 is, for example, an epoxy resin-based adhesive.

The link portion 83 connects the first support wall 81 and the second support wall 82. The link portion 83 extends in the lateral direction (X1, X2). The height of the link portion 83 is lower than the height of the first support wall 81 and the second support wall 82. The link portion 83 is disposed in the opening 93.

The fixing member 80 includes a plurality of first protrusions 88*a* and 88*b* and a plurality of second protrusions 89*a* and 89*b*. The plurality of first protrusions 88*a* and 88*b* and the plurality of second protrusions 89*a* and 89*b* project from the link portion 83. The plurality of first protrusions 88*a* and 88*b* and the plurality of second protrusions 89*a* and 89*b* are disposed in the opening 93. The plurality of first protrusions 88*a* and 88*b* and the plurality of second protrusions 89*a* and 89*b* project toward the inner surface of the opening 93. The plurality of first protrusions 88*a* and 88*b* are aligned with the first support wall 81 in the moving direction (Y1, Y2). The plurality of second protrusions 89*a* and 89*b* are aligned with the second support wall 82 in the moving direction (Y1, Y2). The plurality of first protrusions 88*a* and 88*b* and the plurality of second protrusions 89*a* and 89*b* are in contact with the inner surface of the opening 93, and the fixing member 80 is disposed in the opening 93 by press fitting.

Figure 13:
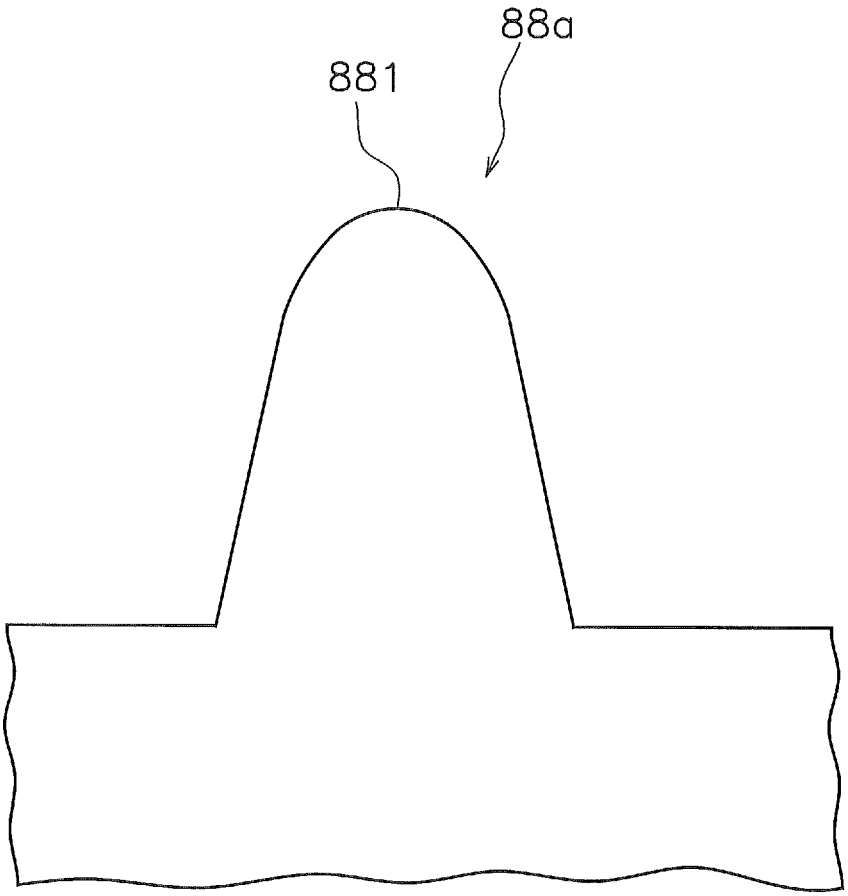
FIG. 13 is an enlarged view of a first protrusion.

FIG. 13 is an enlarged view of the first protrusion 88*a*. As illustrated in FIG. 13, the first protrusion 88*a* includes a curved tip 881. The other first protrusion 88*b* and the second protrusions 89*a* and 89*b* have the same shape as the first protrusion 88*a*. The number of the first protrusions 88*a* and 88*b* is not limited to two and may be one. Alternatively, the number of the first protrusions 88*a* and 88*b* may be more than two. The number of the second protrusions 89*a* and 89*b* is not limited to two, and may be one. Alternatively, the number of the second protrusions 89*a* and 89*b* may be more than two.

As illustrated in FIGS. 9 and 10, the base 11 includes a first notch 94 and a second notch 95. The first notch 94 is disposed at the edge of the first hole 91 on the lower surface of the base 11. The first notch 94 faces the first fixed terminal 13. The second notch 95 is disposed at the edge of the second hole 92 on the lower surface of the base 11. The second notch 95 faces the second fixed terminal 14.

In the electromagnetic relay 1 according to the present embodiment described above, the base 11 is made of the thermosetting resin. Therefore, the electromagnetic relay 1 has high heat resistance. Further, the first fixed terminal 13 and the second fixed terminal 14 are fixed to the base 11 by the fixing member 80. The fixing member 80 has higher elasticity than the thermosetting resin. Therefore, cracking of the base 11 or generation of resin waste can be suppressed. Further, the first fixed terminal 13 and the first support wall 81 are adhered to each other by the first adhesive 85. The second fixed terminal 14 and the second support wall 82 are adhered to each other by the second adhesive 87. Therefore, the first fixed terminal 13 and the second fixed terminal 14 are firmly fixed to the fixing member 80. Further, when the electromagnetic relay 1 is operated, the bounce between the first fixed terminal 13 and the second fixed terminal 14 is suppressed.

The base 11 is provided with the first notch 94 and the second notch 95. When assembling the electromagnetic relay 1, the first fixed terminal 13 is temporarily fixed to the base 11 by filling the first notch 94 with an adhesive while the first fixed terminal 13 is disposed in the first hole 91. Further, the second fixed terminal 14 can be temporarily fixed to the base 11 by filling the second notch 95 with an adhesive while the second fixed terminal 14 is disposed in the second hole 92. After that, by attaching the fixing member 80 to the base 11, the first fixed terminal 13 and the second fixed terminal 14 can be easily fixed to the base 11.

Although one embodiment of the present invention has been described above, the present invention is not limited to the above embodiment, and various modifications can be made without departing from the gist of the invention.

In the above embodiment, the coil block 4 pushes the moving member 17 in the second moving direction (Y2), so that the movable contacts 31 to 34 are separated from the fixed contacts 21 to 24. Further, the coil block 4 pulls the moving member 17 in the first moving direction (Y1), so that the movable contacts 31 to 34 contact the fixed contacts 21 to 24. However, the operating direction of the moving member 17 for opening and closing the contacts may be opposite to that of the above embodiment. That is, the coil block 4 may push the moving member 17 in the second moving direction (Y2) so that the movable contacts 31 to 34 may contact the fixed contacts 21 to 24. The coil block 4 may pull the moving member 17 in the first moving direction (Y1) so that the movable contacts 31 to 34 may be separated from the fixed contacts 21 to 24.

The shapes or arrangements of the first fixed terminal 13, the second fixed terminal 14, the first movable contact piece 15, and the second movable contact piece 16 may be changed. For example, the first fixed terminal 13 and the second fixed terminal 14 may protrude from the base 11 in a direction different from that of the above embodiment.

The first movable contact piece 15 and the second movable contact piece 16 may be integrated with each other. That is, the first to fourth movable contacts 31 to 34 may be connected to the integrated movable contact piece. Alternatively, the second movable contact piece 16, the third and fourth movable contacts 33 and 34, and the third and fourth fixed contacts 23 and 24 may be omitted.

The shapes or arrangements of the coil 61, the spool 62, the movable iron core 63, the fixed iron core 64, or the yoke 65 may be changed. The shapes or arrangements of the first to fourth fixed contacts 21 to 24 may be changed. The shapes or arrangements of the first to fourth movable contacts 31 to 34 may be changed. The shape of the base 11 may be changed.

The first fixed contact 21 and/or the third fixed contact 23 may be integrated with the first fixed terminal 13. The first fixed contact 21 and/or the third fixed contact 23 may be a part of the first fixed terminal 13 and may be flush with other part of the first fixed terminal 13. The second fixed contact 22 and/or the fourth fixed contact 24 may be integrated with the second fixed terminal 14. The second fixed contact 22 and/or the fourth fixed contact 24 may be a part of the second fixed terminal 14 and may be flush with other part of the second fixed terminal 14.

The first movable contact 31 and/or the second movable contact 32 may be integrated with the first movable contact piece 15. The first movable contact 31 and/or the second movable contact 32 may be a part of the first movable contact piece 15 and may be flush with other part of the first movable contact piece 15. The third movable contact 33 and/or the fourth movable contact 34 may be integrated with the second movable contact piece 16. The third movable contact 33 and/or the fourth movable contact 34 may be a part of the second movable contact piece 16 and may be flush with other part of the second movable contact piece 16.

The shape of the moving member 17 is not limited to that of the above embodiment, and may be changed. The shape of the first member 17*a* may be changed.

For example, the first member 17*a* may be a separate body from the link portion 27 and the connecting portion 26. The shape of the second member 17*b* may be changed. The shape of the link portion 27 may be changed. The shape of the connecting portion 26 may be changed.

The materials of the base 11, the fixing member 80, the first adhesive 85, and the second adhesive 87 are not limited to those of the above embodiment, and may be changed. The shape of the base 11 is not limited to that of the above embodiment, and may be changed. For example, the positions or shapes of the first hole 91 and the second hole 92 may be changed. The position or shape of the opening 93 may be changed. The positions or shapes of the first notch 94 and the second notch 95 may be changed. The first notch 94 and the second notch 95 may be omitted.

The shape of the fixing member 80 is not limited to that of the above embodiment, and may be changed. For example, the positions or shapes of the first support wall 81 and the second support wall 82 may be changed. The position or shape of the link portion 83 may be changed. The positions or shapes of the first protrusions 88*a* and 88*b* and the second protrusions 89*a* and 89*b* may be changed. The first protrusions 88*a* and 88*b* and the second protrusions 89*a* and 89*b* may be omitted. The fixing member 80 may be divided into two or more parts. For example, the fixing member 80 may be divided at the link portion 83. The first fixed terminal 13 and the second fixed terminal 14 may be fixed by the divided parts.

REFERENCE SIGNS LIST

11: Base, 13: First fixed terminal, 14: Second fixed terminal, 80: Fixing member, 81: First support wall, 82: Second support wall, 83: Link portion, 84: First recess, 85: First adhesive, 86: Second recess, 87: Second adhesive, 88*a*: First protrusion, 91: First hole, 92: Second hole, 93: Opening, 94: First notch

The invention claimed is:

1. An electromagnetic relay comprising:

a base made of a thermosetting resin, the base including a first hole;

a first fixed terminal extending through the first hole;

a fixing member that is a separate body from the base, the fixing member having higher elasticity than the thermosetting resin, the fixing member fixing the first fixed terminal to the base, the fixing member including a first support wall disposed between an inner surface of the first hole and the first fixed terminal, the first support wall extending upward along the first fixed terminal, and a recess disposed on an upper surface of the first support wall, the recess facing the first fixed terminal; and a first adhesive filled in the first recess, the first adhesive adhering the first fixed terminal and the first support wall.

2. The electromagnetic relay according to claim 1, wherein the base further includes a second hole, the electromagnetic relay further comprises a second fixed terminal extending through the second hole; and a second adhesive, the fixing member further includes a second support wall disposed between an inner surface of the second hole and the second fixed terminal, the second support wall extending upward along the second fixed terminal, and a second recess disposed on an upper surface of the second support wall, the second recess facing the second fixed terminal, and the second adhesive is filled in the second recess and adheres the second fixed terminal and the second support wall.

3. The electromagnetic relay according to claim 2, wherein the fixing member further includes a link portion that connects the first support wall and the second support wall, and the first support wall, the link portion, and the second support wall are integrally formed with each other.

4. The electromagnetic relay according to claim 2, wherein the second adhesive is made of a material that is harder than the fixing member.

5. The electromagnetic relay according to claim 1, wherein the first adhesive is made of a material that is harder than the fixing member.

6. The electromagnetic relay according to claim 1, wherein the base further includes an opening adjacent to the first hole, the fixing member is disposed in the opening by press fitting, and the fixing member further includes a plurality of protrusions disposed in the opening, the plurality of protrusions being in contact with the base.

7. The electromagnetic relay according to claim 6, wherein the plurality of protrusions extend in a vertical direction, and each of the plurality of protrusions includes a curved tip.

8. The electromagnetic relay according to claim 1, wherein the base includes a notch located at an edge of the first hole.

* * * * *